US007721385B2

(12) United States Patent
Genn et al.

(10) Patent No.: US 7,721,385 B2
(45) Date of Patent: May 25, 2010

(54) FILTER HOUSING FOR A DOMESTIC APPLIANCE

(75) Inventors: Stuart Lloyd Genn, Wiltshire (GB); Richard Anthony Mason, Wiltshire (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 1635 days.

(21) Appl. No.: 10/504,056

(22) PCT Filed: Feb. 3, 2003

(86) PCT No.: PCT/GB03/00437

§ 371 (c)(1),
(2), (4) Date: Aug. 10, 2004

(87) PCT Pub. No.: WO03/068041

PCT Pub. Date: Aug. 21, 2003

(65) Prior Publication Data

US 2005/0039426 A1 Feb. 24, 2005

(30) Foreign Application Priority Data

Feb. 11, 2002 (GB) ..... 0203150.8

(51) Int. Cl.
*A47L 9/00* (2006.01)

(52) U.S. Cl. ..... 15/347; 15/320; 15/414; 55/418

(58) Field of Classification Search ..... 15/347, 15/320, 414, 406; 55/413–416, DIG. 3, 347, 55/353

See application file for complete search history.

(56) References Cited

U.S. PATENT DOCUMENTS

| | | | | |
|---|---|---|---|---|
| 4,195,969 | A * | 4/1980 | Whitney | 417/247 |
| 4,403,371 | A | 9/1983 | Kiyooka | |
| 5,946,771 | A * | 9/1999 | Bosyj et al. | 15/347 |
| 5,961,676 | A * | 10/1999 | King et al. | 55/334 |
| 5,961,677 | A | 10/1999 | Scott | |
| 7,261,762 | B2 * | 8/2007 | Kang et al. | 95/1 |
| 2005/0039426 | A1 * | 2/2005 | Genn et al. | 55/418 |
| 2006/0085943 | A1 * | 4/2006 | Gammack et al. | 15/323 |

FOREIGN PATENT DOCUMENTS

DE 38 15 321 11/1989

(Continued)

OTHER PUBLICATIONS

Notification of reasons for rejection dated Feb. 13, 2007 directed to counterpart Japanese application No. 2003-567233.

*Primary Examiner*—Lee D Wilson
(74) *Attorney, Agent, or Firm*—Morrison & Foerster LLP

(57) ABSTRACT

A filter housing includes an inlet for receiving an airflow, a cavity for receiving a filter and an airflow passage between the inlet and the cavity. At least one vane, positioned in the airflow passage, partitions the airflow passage into a plurality of ducts. The vanes lie adjacent to, or contact, the upstream surface of the filter such that each duct communicates with a separate portion of the upstream surface of the filter. The airflow passage extends in a direction which is inclined to the upstream surface of the filter. The vanes help to distribute the flow of air more evenly across the surface of the filter and also help to reduce acoustic emissions from the machine of which the filter housing forms a part.

18 Claims, 7 Drawing Sheets

FOREIGN PATENT DOCUMENTS

| | | |
|---|---|---|
| DE | 199 03 734 A1 | 8/2000 |
| EP | 0 636 337 | 2/1995 |
| GB | 1047804 | 11/1966 |
| GB | 0 042 723 B1 | 8/1985 |
| JP | 51-34572 | 3/1976 |
| JP | 2-128733 | 5/1990 |
| JP | 6-000317 | 1/1994 |

* cited by examiner

FILTER HOUSING FOR A DOMESTIC APPLIANCE

FIELD OF THE INVENTION

The invention relates to a filter housing. Particularly, but not exclusively, the invention relates to a filter housing for use in a domestic appliance such as a vacuum cleaner.

BACKGROUND OF THE INVENTION

Vacuum cleaners are required to separate dirt and dust from an airflow. Dirt and dust-laden air is sucked into the appliance via either a floor-engaging cleaner head or a tool connected to the end of a hose and wand assembly. The dirty air passes to some kind of separating apparatus which attempts to separate dirt and dust from the airflow. Many vacuum cleaners suck or blow the dirty air through a porous bag so that the dirt and dust is retained in the bag whilst cleaned air is exhausted to the atmosphere. In other vacuum cleaners, cyclonic or centrifugal separators are used to spin dirt and dust from the airflow (see, for example, EP 0 042 723). Whichever type of separator is employed, there is commonly a risk of a small amount of dust passing through the separator and being carried to the fan and motor unit, which is used to create the flow of air through the vacuum cleaner whilst it is in operation. Also, with the majority of vacuum cleaner fans being driven by a motor with carbon brushes, such as an AC series motor, the motor emits carbon particles which are carried along with the exhaust flow of air.

In view of this, it is common for a filter to be positioned after the motor and before the point at which air is exhausted from the machine. Such a filter is often called a 'post motor' filter.

There is an increasing awareness among consumers of the problem of emissions, which can be particularly problematic for asthma sufferers. Thus, recent vacuum cleaner models are fitted with filters which have a large surface area of filter material, and the filters often comprise several types of filter material and a foam pad. Such filters are physically bulky and housing such filters in the cleaner is quite challenging. A vacuum cleaner called the Dyson DC05, manufactured and sold by Dyson Limited, houses a circular post motor filter beneath the dirt collection bin. Air flows towards a first face of the filter, passes through the filter and exhausts from the machine via a set of apertures in the cover above the filter.

U.S. Pat. No. 5,961,677 shows a vacuum cleaner exhaust filter in which air flows out of a central conduit, via a series of openings formed between angled vanes, before passing through an open space to a cylindrical filter which surrounds the central conduit.

SUMMARY OF THE INVENTION

The present invention seeks to provide an improved filter housing.

Accordingly, the present invention provides filter housing comprising an inlet for receiving an airflow, a cavity for receiving a filter, a filter located in the cavity, an airflow passage extending between the inlet and the filter cavity and at least one vane positioned in the airflow passage so as to partition the airflow passage into a plurality of separate ducts, each vane extending to, or contacting, an upstream surface of the filter such that each duct communicates with a separate portion of the upstream surface of the filter, wherein the airflow passage extends in a direction which is inclined to the upstream surface of the filter.

The vanes provide the advantage of more evenly distributing the flow of air across the surface of the filter when the incoming air presented to the filter follows a path which is not perpendicular to the surface of the filter. The vanes serve to force the airflow to distribute itself across the filter surface in a more even manner. This can have benefits in extending the time between occasions when a user needs to replace or clean the filter. The vanes also help to support the filter and can increase the rigidity of the filter housing.

This arrangement is particularly effective in when the space available immediately upstream of the filter is restricted and when the airflow passage is not symmetrical about the inlet to the airflow passage, i.e. where the inlet is 'off-centre' with respect to the airflow passage or chamber. In this case, the vanes serve an important purpose in reducing swirl in the airflow which could otherwise increase back pressure in the overall system and/or cause undue wear to the filter surface.

Preferably the vanes have a non-linear shape in the direction of flow through the airflow passage. More preferably, each vane has an arcuate shape along its entire length. This serves to reduce acoustic emissions from the machine since sound waves emitted by the fan and/or motor are caused to bounce off the vanes, thus causing the vanes to absorb some of the sound energy.

Preferably the total cross sectional area of the inlet to each duct is substantially proportional to the area of the upstream surface of the filter with which the respective duct communicates. This encourages even dust loading across the filter.

Although this invention is described in relation to a cylinder (canister) vacuum cleaner, it will be apparent that it can be applied to other kinds of vacuum cleaner, domestic appliances or machines which use a filter of some kind.

BRIEF DESCRIPTION OF THE DRAWINGS

Embodiments of the invention will now be described with reference to the accompanying drawings in which.

DETAILED DESCRIPTION OF THE INVENTION

Figure 1:
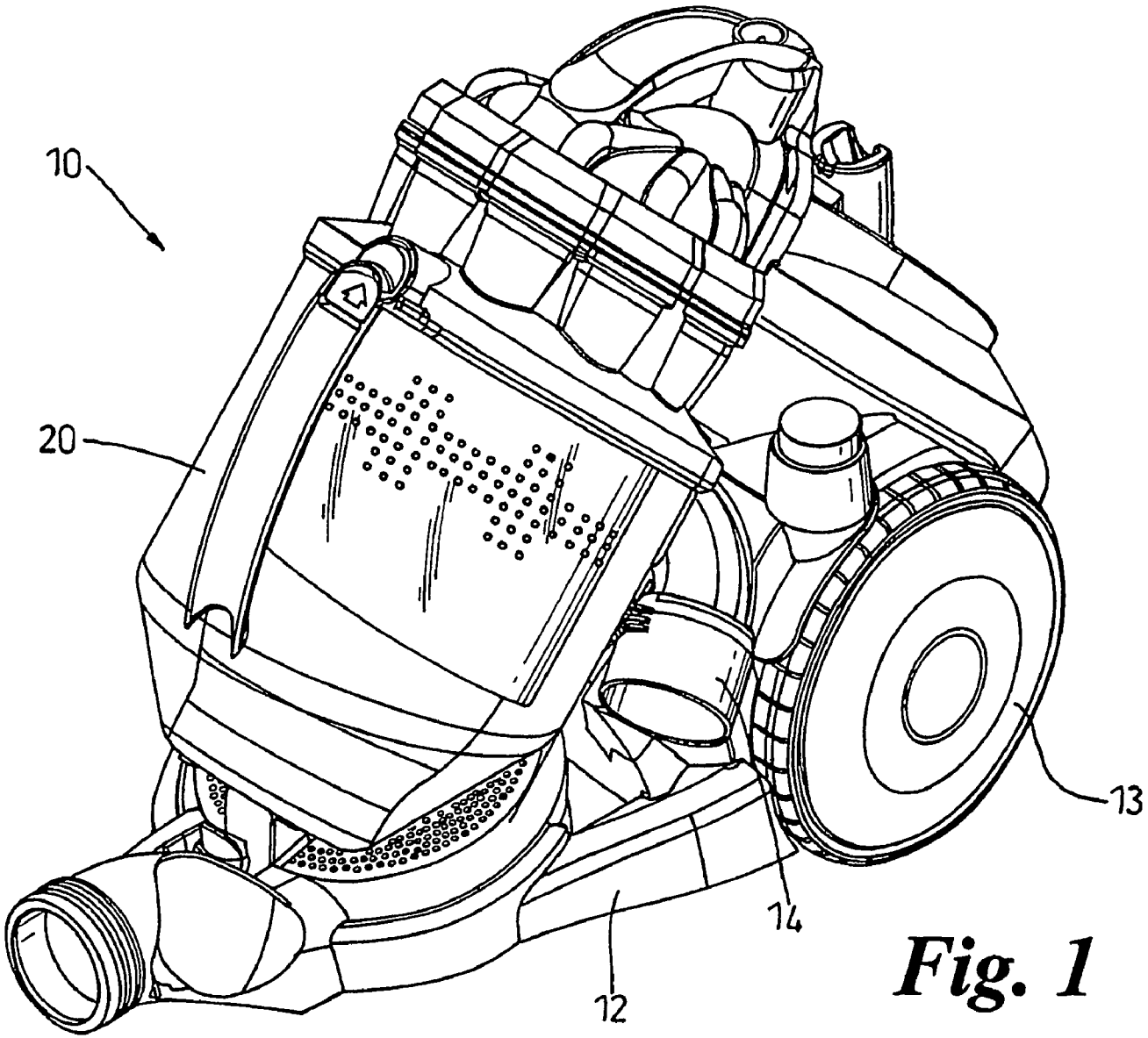
FIG. 1 is a perspective view of a vacuum cleaner in which a filter housing according to the invention is embodied.
Figure 2:
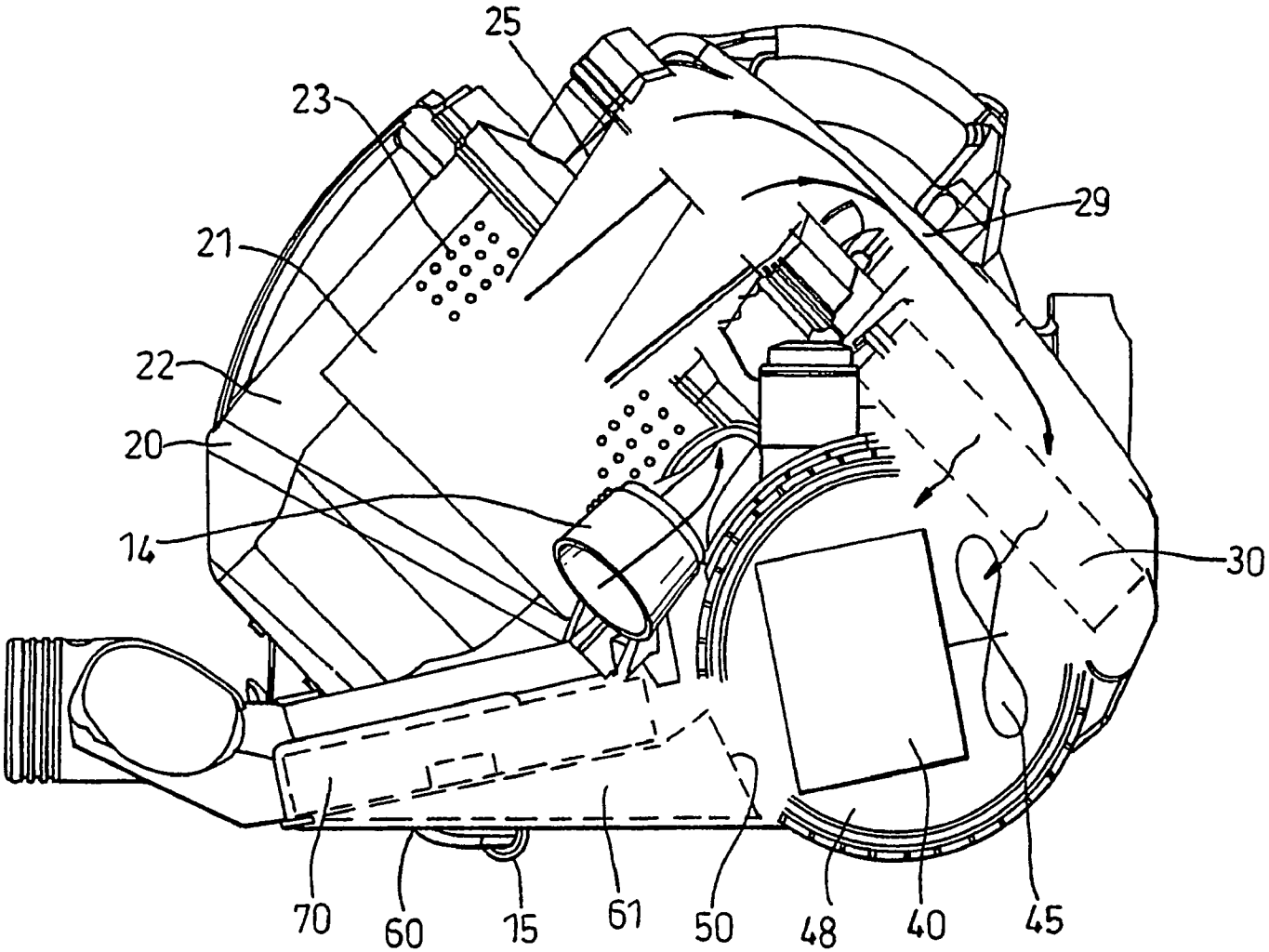
FIGS. 2 and 3 are side views of the vacuum cleaner of FIG. 1, showing some of the internal components of the cleaner.
Figure 3:
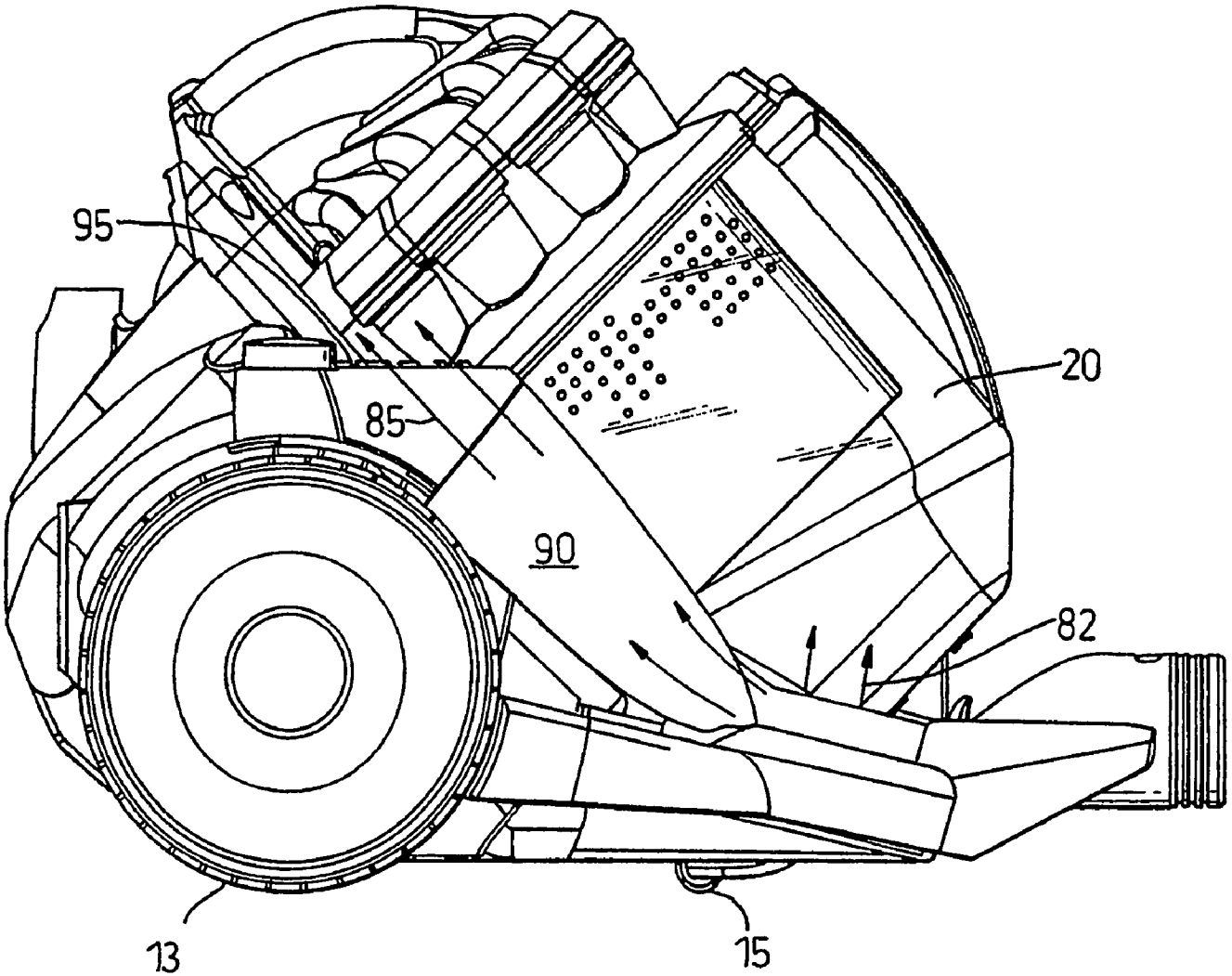

FIGS. 1 to 3 show an example of a vacuum cleaner 10 in which the invention is embodied. The vacuum cleaner 10 is a cylinder or canister type of vacuum cleaner comprising a chassis 12 with wheels 13, 15 for allowing the chassis 12 to be moved across a surface to be cleaned. The chassis 12 supports a chamber 20 which serves as a separator for separating dirt, dust and other debris from an airflow and also as a collector for the separated material. While a cyclonic separator is shown here, the separator can take any form and this is not important to the invention. Chamber 20 is removable from the chassis 12 such that a user can empty the chamber 20.

Although not shown for reasons of clarity, a hose connects to inlet 14 of the vacuum cleaner 10 and a user can fit a wand or tools to the distal end of the hose for use in cleaning various surfaces.

FIGS. 2 and 3 show some of the internal components of the vacuum cleaner 10 of FIG. 1. The chamber 20 communicates with the inlet 14 through which an airflow can enter the chamber in a tangential manner. The chamber 20 has an apertured shroud 21 mounted centrally within it. The region 22 externally of the shroud 21 forms a first cyclonic separation stage. The apertures 23 in the shroud 21 communicate with a second cyclonic separation stage comprising a set of frusto-conical separators 25 arranged in parallel. The outlets of the second stage separators 25 are connected, via a duct 29, to a housing for a pre-motor filter 30. The pre-motor filter 30 serves to trap any fine dust or microscopic particles which have not been separated by the two cyclonic separation stages 22, 25. The downstream side of the pre-motor filter 30 communicates with a fan and motor housing 48. This housing 48 accommodates an impeller 45 which is driven by a motor 40. The outlet of the housing 48 communicates, via an aperture 50, with a filter housing 60. The filter housing 60 houses a post-motor filter 70 which serves to trap any particles remaining in the airflow, as well as carbon particles emanating from the motor 40. The downstream side of the filter housing 60 communicates with an exhaust duct 90 having outlet apertures 95 at its furthest end.

Figure 4:
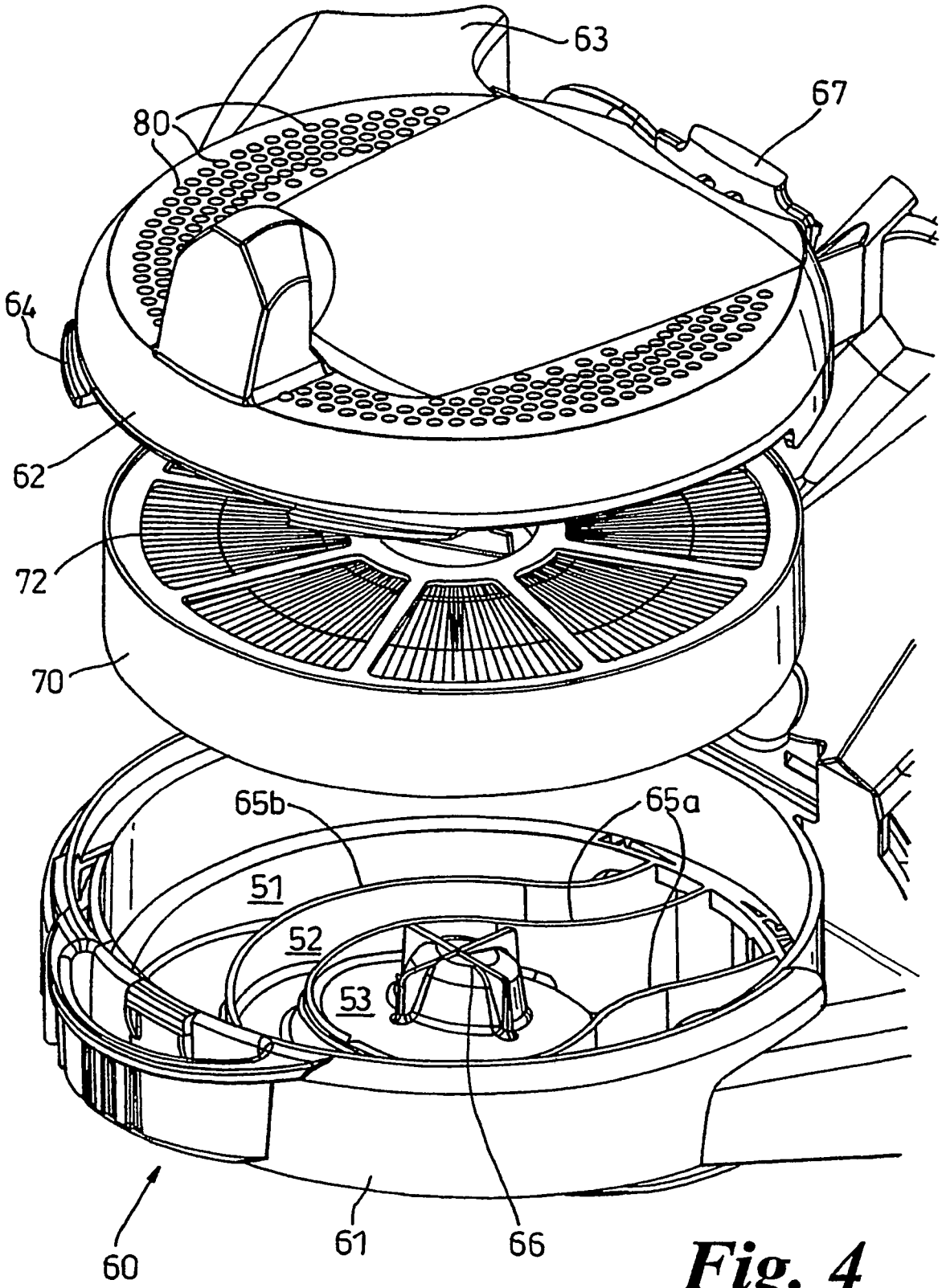
FIG. 4 shows the filter housing of the vacuum cleaner of FIGS. 1 to 3.

The filter housing 60 will now be described in more detail with reference to FIG. 4. The filter housing 60 comprises a lower part 61, which in this embodiment forms part of the chassis 12 of the vacuum cleaner 10, and an upper part 62. The upper part 62 fits removably to the lower part 61 by means of lugs 64 and a snap fastener 67. Other types of fastener could, of course, be used. The lower part 61 defines an airflow passage which communicates at its upstream end with the aperture 50 which forms the outlet from the housing 48. The space between the lower part 61 and the upper part 62 defines a cavity for housing the filter 70. The upper part 62 has an outlet branch 63 which mates, in an airtight manner, with the lower end of the exhaust duct 90.

A plurality of vanes 65*a*, 65*b*, 65*c* are located in the airflow passage. Two of the vanes 65*a*, 65*b* extend from the aperture 50 and into the area of the airflow passage which lies adjacent the cavity for receiving the filter 70. In this area, the vanes 65*a*, 65*b* extend from the lower part 61 towards the upper part 62 so that they lie adjacent, or even contact, the filter 70. A third vane 65*c* extends from the aperture 50 towards the area of the airflow passage which lies adjacent the cavity for receiving the filter 70 but terminates immediately before the said area. Three separate ducts 51, 52, 53 are formed between the vanes 65*a*, 65*b*, 65*c*.

Figure 5:
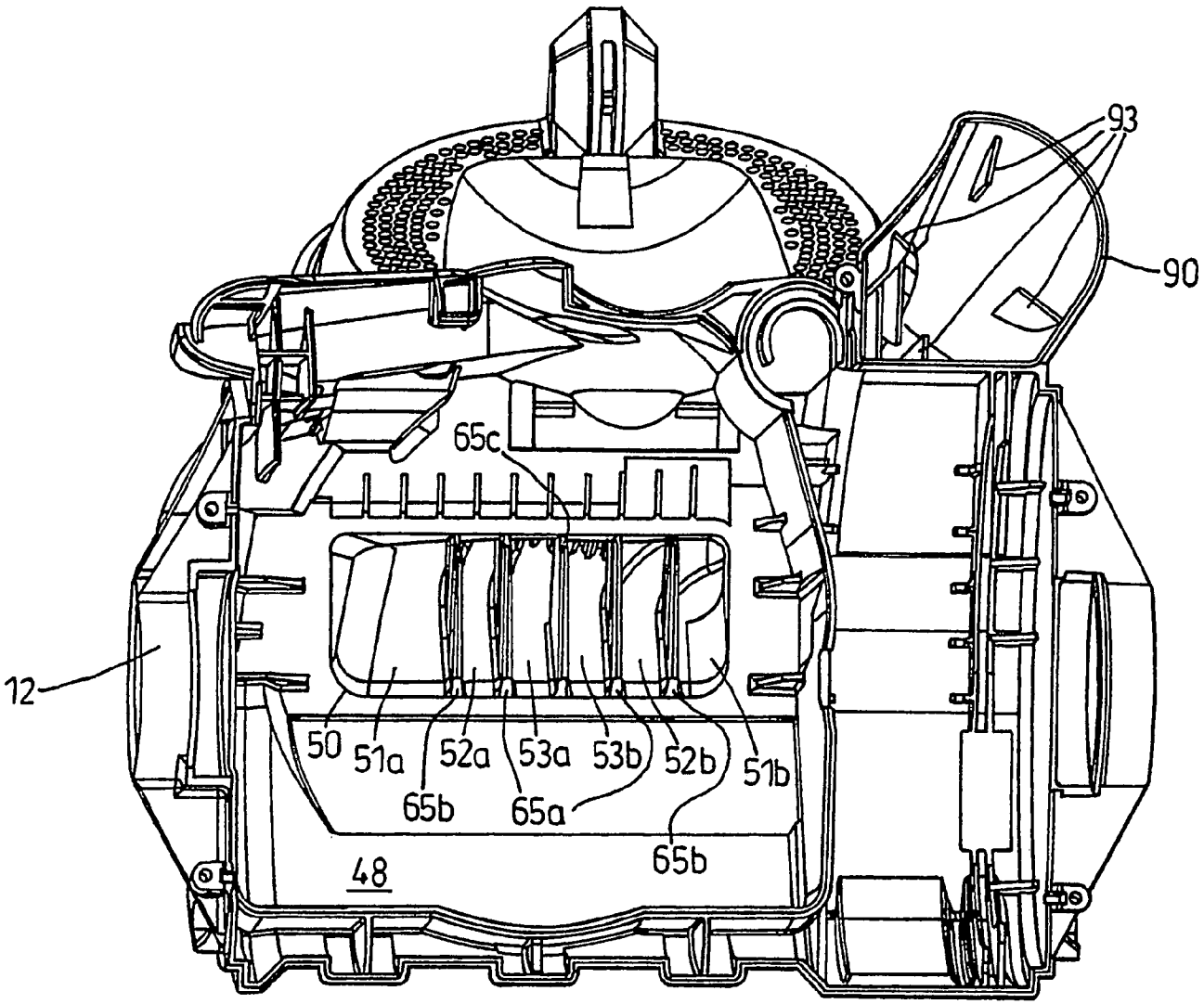
FIG. 5 shows the chassis of the vacuum cleaner and the conduit leading to the filter housing of FIG. 4.

The vanes 65*a*, 65*b*, 65*c* serve to guide the airflow passing through the vacuum cleaner 10 to and from the filter 70. The vanes 65*a*, 65*b*, 65*c* extend from the outlet 50 of the motor housing 48 along the lower surface of part 61. The vanes 65*a*, 65*b* continue beneath the area where filter 70 is located. The vanes 65*a*, 65*b*, 65*c* have two uses: firstly they serve to distribute airflow across the surface of the filter 70 in a reasonably uniform manner, and secondly their non-linear shape serves to attenuate sound from the impeller 45. Referring to FIG. 5, the vanes 65*a*, 65*b*, 65*c* divide outlet 50 into six apertures 51*a*, 51*b*, 52*a*, 51*b*, 53*a*, 53*b*. In use, this causes the flow of air from the impeller 45 to be divided into six separate flows. Each aperture 51*a*, 51*b*, 52*a*, 52*b*, 53*a*, 53*b* forms an inlet to one of the ducts 51, 52, 53. Each duct 51, 52, 53 communicates with a distinct and separate portion of the surface area of the filter 70. The height of each vane 65*a*, 65*b* is chosen such that the distal edges thereof lie adjacent, and preferably touch, the surface of the filter 70 when the filter is fitted in the filter housing 60. Thus, each duct 51, 52, 53 communicates with a separate and distinct portion of the filter 70 so that air flowing along each duct 51, 52, 53 is constrained to flow through the respective portion of the filter 70.

Referring again to FIG. 2 it can be seen that the upstream surface of the filter 70 lies, in use, at an acute angle (approximately 10°) with respect to the incoming airflow from the motor housing 48. The division of the airflow into separate portions in the manner just described helps to distribute the airflow evenly across the surface of the filter 70, even though the arrangement of the filter 70 with respect to the incoming airflow is not ideal for even distribution. It is particularly beneficial that each duct 51, 52, 53 serves a portion of the filter surface which is a different distance from the inlet 50; i.e. duct 51 serves the remote portion of the filter 70, duct 52 the middle section, and duct 53 the nearest portion of the filter surface 70.

Figure 6:
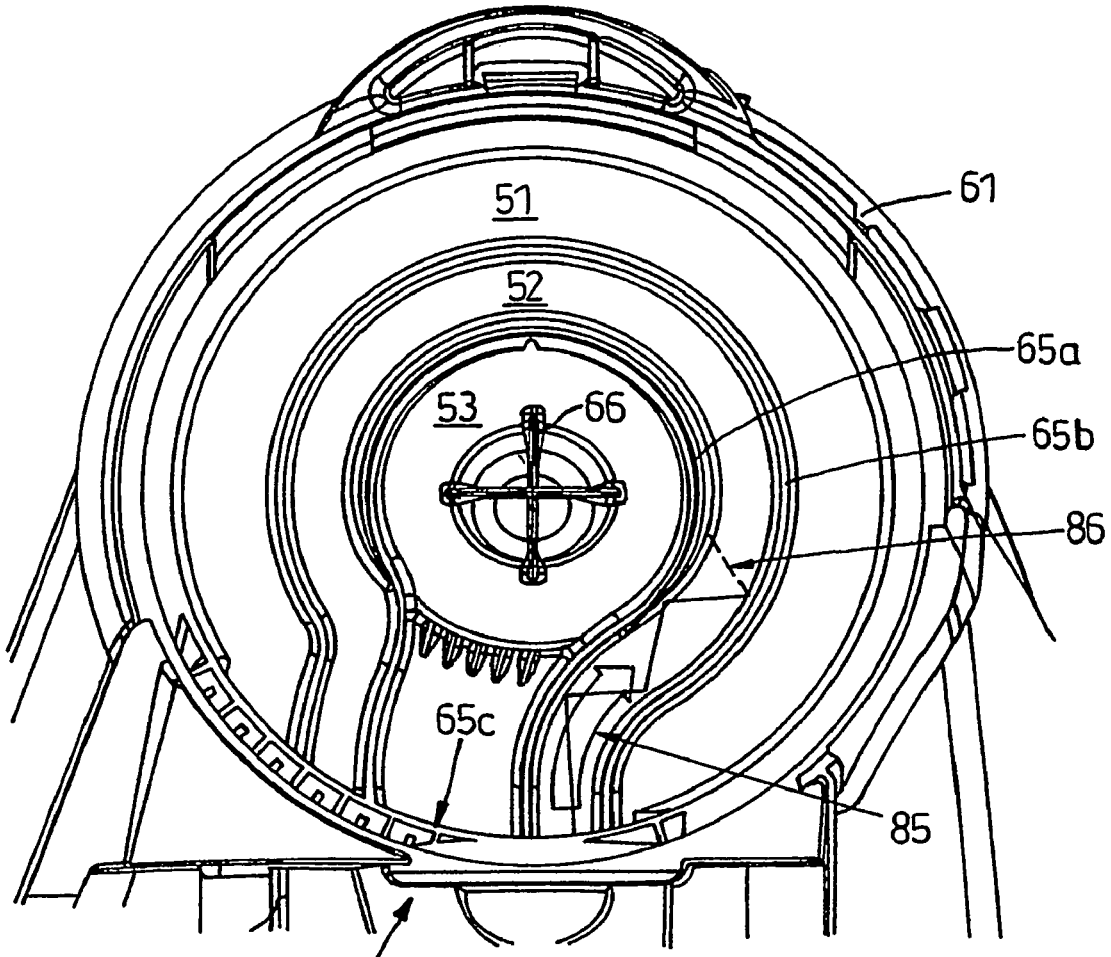
FIG. 6 is a plan view of the lower part of the filter housing of FIG. 4.

FIG. 6 shows the lower part 61 of the filter housing 60 in plan view. The path taken by the airflown along part of the duct 52 is shown by arrow 85 while the path taken by sound waves is shown by arrow 86. Due to the shape of the vanes 65*a*, 65*b*, it can be seen that the sound waves are forced to bounce between the vanes 65*a*, 65*b* on multiple occasions or at the very least provide an obstruction to sound waves emanating from the motor housing 48. Vanes 65*a*, 65*b*, 65*c* can be moulded or otherwise formed integrally with the lower part 61 of the filter housing 60 or they can be provided as a separate part or set of parts which locate within the lower part 61 of the filter housing 60.

Figure 7:
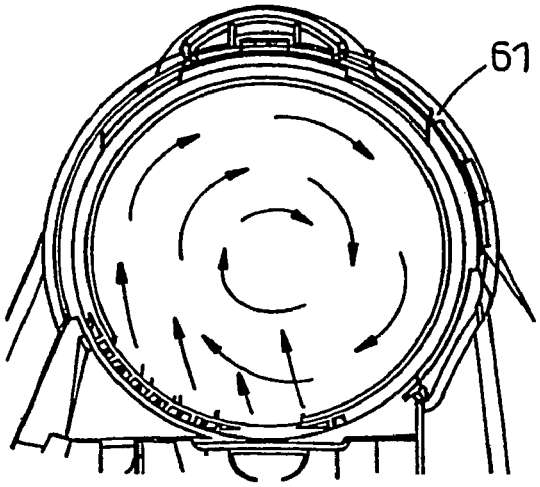
FIGS. 7 and 8 illustrate the effect of vanes in reducing swirl in the airflow.
Figure 8:
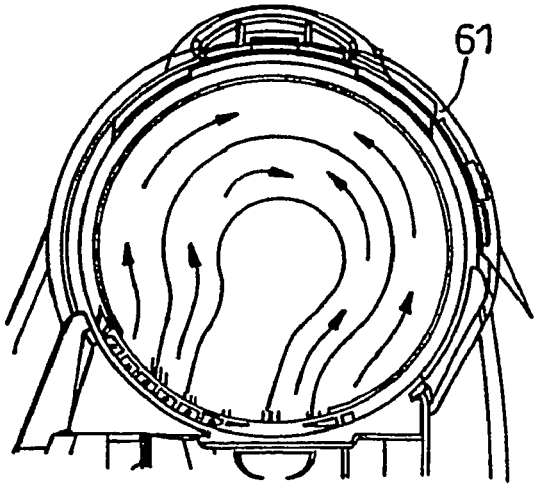

The provision of the vanes 65*a*, 65*b*, 65*c* described above is also particularly beneficial where the airflow inlet 50 is off-centre with respect to the filter housing 60. FIG. 7 shows the expected airflow without the presence of vanes of this sort. Air enters the 5 filter housing 60 and swirls around the housing. This swirling airflow can cause added noise and can further reduce suction power. FIG. 8 shows the effect of positioning vanes 65*a*, 65*b* within the filter housing 60. Air entering the filter housing 60 is now unable to swirl to any noticeable degree.

Figure 9:
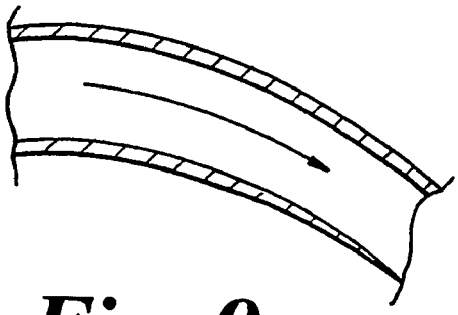
FIGS. 9 and 10 illustrate the effect of the shape of the vanes in the filter housing of FIG. 6.
Figure 10:
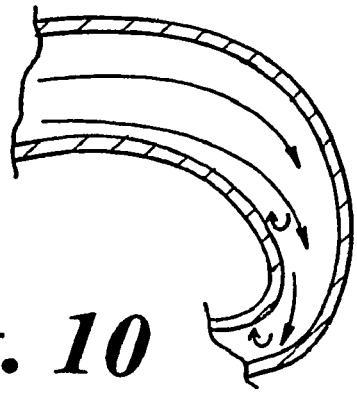

The shape of the vanes 65*a*, 65*b*, 65*c* ensures a smooth transition between directions and section changes which helps to avoid 'break away' and turbulence which increase noise and back pressure. It is particularly desirable to minimise back pressure in a vacuum cleaner as it reduces suction power. FIGS. 9 and 10 show the effect of 'break away' airflow by contrasting a smoothly curved duct (FIG. 9) with a duct which is curved too sharply (FIG. 10).

The position of the vanes 65*a*, 65*b*, 65*c* within the outlet aperture 50 of the motor housing 48 is chosen such that the cross sectional area of the inlet to each duct 51, 52, 53 is substantially proportional to the surface area of the filter portion served by that duct. This helps to ensure that the airflow is evenly distributed across the filter surface. The provision of two inlets to each duct (e.g. inlets 51*a*, 51*b* to duct 51) also helps to balance the airflow to the filter.

Filter 70 is shown here as a pleated filter, in which a cylindrical plastic case houses a pleated structure 72. Other types of filter, e.g. a simple foam pad filter, could be used in place of what has been shown here. Preferably the post-motor filter is a BEPA (High Efficiency Particulate Air) filter.

Figure 11:
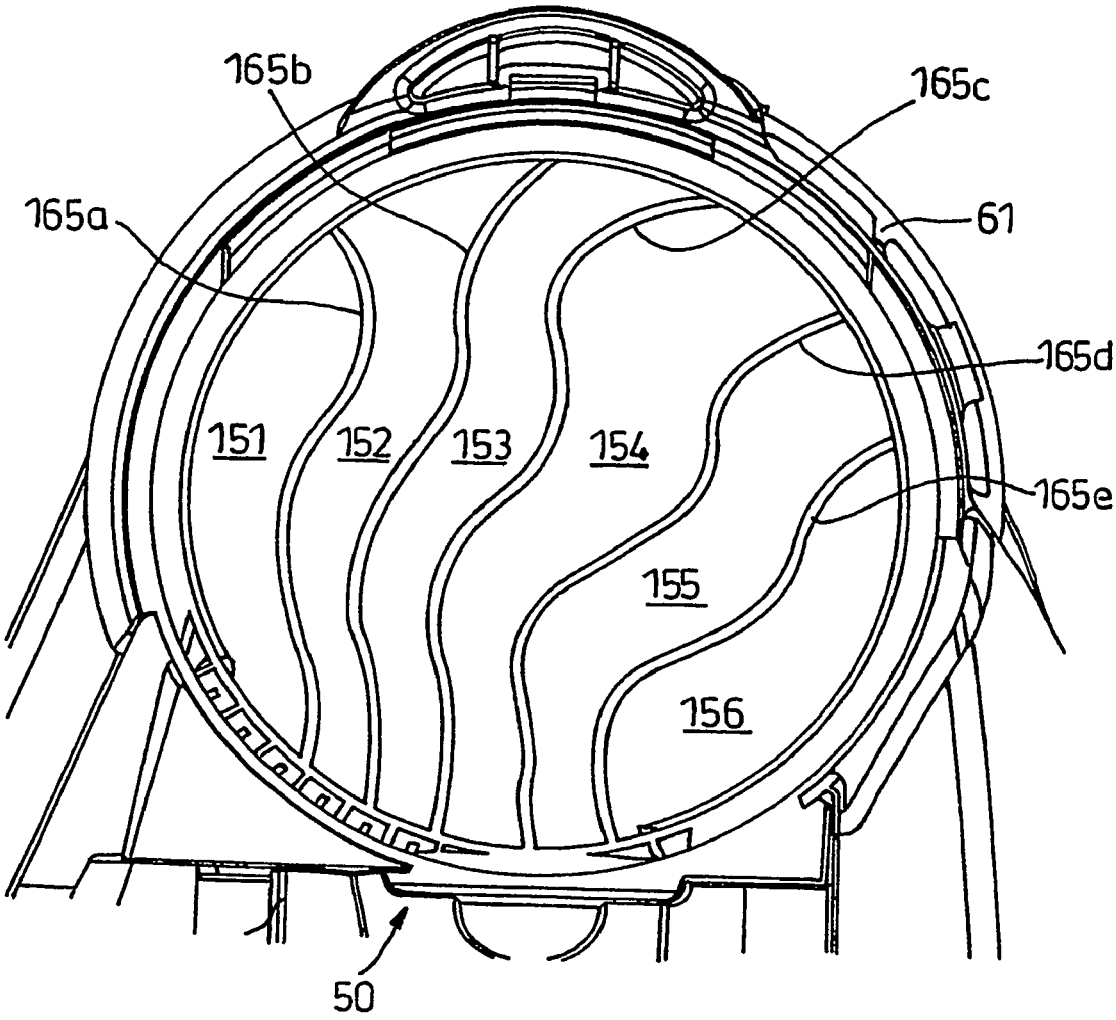
FIG. 11 is a plan view of an alternative embodiment of the lower part of the filter housing.

FIG. 11 shows a plan view of an alternative embodiment of the lower part 61 of the filter housing 60. In this embodiment, a set of vanes 165*a*-165*e* are positioned in a different manner to that shown in FIG. 6. Here, the vanes 165*a*-165*e* extend outwardly from the outlet aperture 50 of the motor housing 48 towards the furthermost side of the lower part 61 of the filter housing 60. As before, this arrangement of vanes divides the area beneath the filter 70 into a plurality of ducts 151-156, each duct communicating with a different portion of the filter surface. Each vane has a non-linear, sinuous shape which enhances the likelihood of sound waves colliding with at least one of the vanes. In use, incoming airflow will be divided into a plurality of separate portions, each portion flowing along a respective duct. As before, the cross-section of each inlet is proportional to the filter area served by the inlet.

The operation of the vacuum cleaner will now be described. In use, air is drawn by the motor-driven impeller 45, through any floor tool and hose into inlet 14 of the vacuum cleaner 10. The dirty air passes through the cyclonic separation stages 22, 25, during which dirt and dust is removed from the airflow in a maimer which is well documented elsewhere. Air flows from the outlet of cyclones 25, along duct 29, through pre motor filter 30 and into the motor housing 48. Exhaust air is blown towards the aperture 50 and is there divided into six portions by the leading edges of the vanes 65*a*, 65*b*, 65*c*. The divided portions of the airflow flow along the three ducts 51, 52, 53. As described above, acoustic waves bounce along the ducts 51, 52, 53 between opposing vanes 65*a*, 65b. Airflow from the ducts 51, 52, 53 then passes through the portion of the post-motor filter 70 with which each respective duct 51, 52, 53 communicates. After passing through the filter 70, air passes to the inlet to the exhaust duct 90. Some of the air vents to atmosphere via apertures 80 in the upper face of the filter housing part 62 (see arrows 82, FIG. 3). The remainder of the air flows along the exhaust duct 90. As the air flows along the exhaust duct 90, it slows down because the duct 90 widens in the direction of flow. This air vents to atmosphere via apertures 95 (see arrows 85, FIG. 3).

The invention claimed is:

1. A filter housing comprising an inlet for receiving an airflow, a cavity for receiving a filter, a filter located in the cavity, an airflow passage extending from the inlet into the filter cavity and at least one vane positioned in the airflow passage of the cavity so as to partition the airflow passage into a plurality of separate elongated ducts, each vane extending to, or contacting, an upstream surface of the filter such that each duct communicates with a separate portion of the upstream surface of the filter, wherein the airflow passage extends along the ducts in a direction which is inclined to the upstream surface of the filter.

2. A filter housing according to claim 1, wherein the airflow passage is inclined at an angle of approximately 10° to the upstream surface of the filter.

3. A filter housing according to claim 1 or 2, wherein each vane has a non-linear shape in the direction of flow through the airflow passage.

4. A filter housing according to claim 3, wherein each vane has an arcuate shape along an entire length of the vane.

5. An appliance comprising an inlet, a filter housing according to claim 4, an exhaust assembly, and an airflow generator for generating an airflow through the appliance from the inlet to the exhaust assembly.

6. A vacuum cleaner comprising the appliance according to claim 5 and a separator for separating dirt and dust from the airflow.

7. A filter housing according to claim 3, wherein at least one of the ducts has two separate inlets, both of the inlets communicating with a source of airflow.

8. A filter housing according to claim 3, wherein the total cross sectional area of the inlet to each duct is substantially proportional to the area of the upstream surface of the filter with which the respective duct communicates.

9. An appliance comprising an inlet, a filter housing according to claim 3, an exhaust assembly, and an airflow generator for generating an airflow through the appliance from the inlet to the exhaust assembly.

10. A vacuum cleaner comprising the appliance according to claim 9 and a separator for separating dirt and dust from the airflow.

11. A filter housing according to claim 1 or 2, wherein at least one of the ducts has two separate inlets, both of the inlets communicating with a source of airflow.

12. An appliance comprising an inlet, a filter housing according to claim 11, an exhaust assembly, and an airflow generator for generating an airflow through the appliance from the inlet to the exhaust assembly.

13. A vacuum cleaner comprising the appliance according to claim 12 and a separator for separating dirt and dust from the airflow.

14. A filter housing according to claim 1 or 2, wherein the total cross sectional area of the inlet to each duct is substantially proportional to the area of the upstream surface of the filter with which the respective duct communicates.

15. An appliance comprising an inlet, a filter housing according to claim 14, an exhaust assembly, and an airflow generator for generating an airflow through the appliance from the inlet to the exhaust assembly.

16. A vacuum cleaner comprising the appliance according to claim 15 and a separator for separating dirt and dust from the airflow.

17. An appliance comprising an inlet, a filter housing according to claim 1 or 2, an exhaust assembly, and an airflow generator for generating an airflow through the appliance from the inlet to the exhaust assembly.

18. A vacuum cleaner comprising the appliance according to claim 17 and a separator for separating dirt and dust from the airflow.

* * * * *